US010975504B2

(12) United States Patent
Paniagua et al.

(10) Patent No.: US 10,975,504 B2
(45) Date of Patent: Apr. 13, 2021

(54) METHOD FOR PRODUCING A WET-LAID NONWOVEN FABRIC

(71) Applicant: VOITH PATENT GMBH, Heidenheim (DE)

(72) Inventors: Juan Paniagua, Moenchengladbach (DE); Andreas Boegershausen, Willich (DE); Frank Schicht, Moenchengladbach (DE)

(73) Assignee: Voith Patent GmbH, Heidenheim (DE)

( * ) Notice: Subject to any disclaimer, the term of this patent is extended or adjusted under 35 U.S.C. 154(b) by 69 days.

(21) Appl. No.: 16/347,291

(22) PCT Filed: Oct. 27, 2017

(86) PCT No.: PCT/EP2017/077600

§ 371 (c)(1),
(2) Date: May 3, 2019

(87) PCT Pub. No.: WO2018/083026

PCT Pub. Date: May 11, 2018

(65) Prior Publication Data

US 2019/0276960 A1 Sep. 12, 2019

(30) Foreign Application Priority Data

Nov. 3, 2016 (DE) ..... 10 2016 120 933.3

(51) Int. Cl.
*F26B 3/34* (2006.01)
*D04H 1/4209* (2012.01)
(Continued)

(52) U.S. Cl.
CPC ..... *D04H 1/4209* (2013.01); *D04H 1/4282* (2013.01); *D04H 1/4326* (2013.01);
(Continued)

(58) Field of Classification Search
CPC ..... D04H 1/4209; D04H 1/4282; D04H 1/64; F26B 5/047; F26B 13/00; F26B 13/105; F26B 17/008; F26B 17/02; F26B 17/023; F26B 17/04; D21F 5/18; D21F 5/002; D21F 5/001
(Continued)

(56) References Cited

U.S. PATENT DOCUMENTS 5,006,183 A 4/1991 Fleissner
5,409,573 A 4/1995 Weeks
(Continued)

FOREIGN PATENT DOCUMENTS

CN 1037749 A 12/1989
DE 3831496 A1 3/1990
(Continued)

*Primary Examiner* — John P McCormack
(74) *Attorney, Agent, or Firm* — Laurence A. Greenberg; Werner H. Stemer; Ralph E. Locher

(57) ABSTRACT

A method for producing a wet-laid nonwoven fabric web includes the following steps: providing a fibrous web of industrially generated inorganic fibers, or fibers from synthetically generated polymers, and thermally drying the fibrous web in an alternating manner by infrared radiation and hot air, in order for the nonwoven fabric web to be generated.

20 Claims, 1 Drawing Sheet

(51) Int. Cl.

| | |
|---|---|
| ***D04H 1/4282*** | (2012.01) |
| ***D04H 1/4326*** | (2012.01) |
| ***D04H 1/64*** | (2012.01) |
| ***F26B 13/00*** | (2006.01) |
| ***D21F 5/18*** | (2006.01) |
| ***D21F 5/00*** | (2006.01) |

(52) U.S. Cl.
CPC ..... *D04H 1/64* (2013.01); *D21F 5/001* (2013.01); *D21F 5/002* (2013.01); *D21F 5/18* (2013.01); *F26B 13/00* (2013.01)

(58) Field of Classification Search
USPC ..... 34/636, 638, 273, 266, 419, 418, 414, 34/444, 611, 619
See application file for complete search history.

(56) References Cited

U.S. PATENT DOCUMENTS

| | | | | |
|---|---|---|---|---|
| 5,496,406 | A | 3/1996 | Beisswanger et al. | |
| 6,088,930 | A * | 7/2000 | Robin | F26B 13/104 34/267 |
| 6,174,826 | B1 | 1/2001 | Williams et al. | |
| 6,497,787 | B1 | 12/2002 | Geel | |
| 6,877,247 | B1 * | 4/2005 | DeMoore | F26B 3/283 34/269 |
| 10,017,901 | B2 | 7/2018 | Ketzer et al. | |
| 2003/0000663 | A1 * | 1/2003 | Geel | D21H 21/54 162/100 |
| 2008/0256818 | A1 | 10/2008 | Lenoir | |
| 2016/0130757 | A1 * | 5/2016 | Mikami | D21F 5/048 162/207 |
| 2019/0203419 | A1 * | 7/2019 | Even | F26B 3/305 |

FOREIGN PATENT DOCUMENTS

| | | | |
|---|---|---|---|
| DE | 68913073 | T3 | 7/2002 |
| DE | 60103999 | T2 | 7/2005 |
| DE | 102004027938 | A1 | 12/2005 |
| DE | 102008042247 | A1 | 4/2010 |
| DE | 102014012159 | A1 | 2/2016 |
| WO | 8800989 | A1 | 2/1988 |
| WO | 8904890 | A1 | 6/1989 |
| WO | 9218693 | A1 | 10/1992 |

* cited by examiner

METHOD FOR PRODUCING A WET-LAID NONWOVEN FABRIC

BACKGROUND OF THE INVENTION

Field of the Invention

The invention relates to a method for producing or drying, respectively, a wet-laid nonwoven fabric.

Known methods for producing nonwoven fabrics from natural fibers such as, for example, cellulosic fibers, typically comprise forming a fibrous web and, subsequently thereto, dewatering such as drying. The actual nonwoven fabric is produced from the fibrous web as a result set drying. Various methods of forming the nonwovens herein are known from the prior art. The forming of the fibrous web is usually carried out by a wet-laying method on an inclined screen former at a very low consistency of the fibrous suspension, specifically by way of a solids content from 0.01 to 0.1% by weight in relation to 100% by weight of the nonwoven obtained.

Natural fibers, as soon as the latter are put into water, typically form hydrogen bridge bonds among one another. This enables nonwoven webs to be able to be produced from natural fibers without the use of binding agents. Such bonds do not arise in the case of man-made fibers such as fibers from synthetically produced polymers, and most particularly in the case of industrially generated inorganic fibers. Until now, corresponding chemical binding agents have had to be resorted to in order for such fibers to be bonded among one another and to thus obtain a load-bearing nonwoven produced by the wet-laid method. On the one hand, chemical binding agents of this type can be added as chemical reagents to the fibrous suspension. On the other hand, wet-laid nonwoven fabrics webs have subsequently been soaked with such a binding agent in a bonding section.

Both methods have the disadvantage that such produced nonwoven fabric webs are subject to a significant drying complexity. On the one hand, the water of the fibrous suspension has to be removed from the nonwoven fabric web. On the other hand, the chemical binding agent has to be cured. Until now, this has been performed by means of drying devices which have only hot air dryers. On account of the exclusive use of such hot air dryers, the nonwoven fabric web to be produced requires comparatively much time in order for said nonwoven fabric web two reach its actual strength, specifically the final strength. As long as the nonwoven fabric web thus does not reach such a strength, said nonwoven fabric web must at all times be supported from below by means of a corresponding belt. This is particularly disadvantageous as soon as it is desired that the nonwoven fabric web be transported onward by means of a free draft, thus without such a belt, to a further section of the machine for producing such nonwoven fabric webs.

The present invention relates to the generic subject matter mentioned at the outset.

SUMMARY OF THE INVENTION

The present invention is based on the object of specifying a method of the type mentioned at the outset by way of which the aforementioned problems are eliminated in a reliable manner that is as simple as possible. In particular, a method in which nonwoven fabric webs, for example from inorganic fibers, by an addition of binding agents can reach the final strength of said nonwoven fabric webs faster than to date, in order to be able to be transported by a free draft, without any support from below is intended to be specified.

The object is achieved as claimed in the independent claims. Particularly preferred and advantageous embodiments of the invention are set forth in the dependent claims.

A fibrous web in the context of the invention is understood to be a cross-laid structure, or random-laid structure, respectively, produced from a fibrous suspension of fibers of a limited length, for example continuous fibers (filaments), or from cut yarns. The fibrous web herein at first, thus immediately upon the forming of said fibrous web, has such a low strength that said fibrous web per se is not load-bearing. Said fibrous web is carried by the forming screen onto which said fibrous web has been deposited, such that said fibrous web does not lose its shape.

A nonwoven fabric or a nonwoven fabric web in the context of the invention is a structure from fibers which in any manner are joined so as to form a nonwoven (that is to say to form a fibrous layer, or to form a fibrous pile, respectively) and are, for example, connected to one another in any manner. In the context of the present invention, said nonwoven fabric is a wet-laid, thus a hydraulically (also: hydro-dynamically) formed nonwoven fabric. The fibrous web can be generated in the forming section of the machine for producing such a nonwoven fabric. In other words, a nonwoven fabric is a solidified, in particular a finally solidified, fibrous web. Finally solidified means that no further measures which cause any further increase in the strength of the nonwoven fabric web in particular the chemical solidification (here: drying). In other words, the fibrous web is an intermediate product of the finally produced, completely solidified nonwoven fabric web. Such a nonwoven fabric is considered to be finally solidified when said nonwoven fabric, by way of the solidification, substantially has such a high strength that said nonwoven fabric is suitable for the intended use.

A (final) solidification in the context of the present invention is at all times performed by means of a chemical solidification method. To this end, the fibrous web is soaked with a curable binding agent. The drying of the fibrous web is performed subsequently to such an impregnation. The excess water, predominantly emanating from the fibrous suspension, is extracted from the fibrous web during the drying. The binding agent cures on account of the thermal influence. The impregnation of the fibrous web can be performed in the forming section and/or in a bonding section of the machine for producing the nonwoven fabric web. The fibrous web dries, preferably completely within the drying section, so as to form the final nonwoven fabric web. The drying can be performed in the drying section of the machine for producing such nonwoven fabric webs.

Fibrous structures produced by crossing or interlooping, respectively, yarns, such as arises in weaving, warp and/or weft knitting, knitting, lace-making, braiding, and the production of tufted products are not nonwoven fabrics in the context of the invention. Films and papers are also not nonwoven fabrics.

When thus mention is made according to the present invention of the production of a wet-laid nonwoven fabric web, this then refers to the drying of a provided with wet-laid fibrous web that is provided with binding agents, so as to form a nonwoven.

The invention also relates to a method for treating a preferably wet-laid nonwoven fabric web.

The term treatment is understood to be the subsequent treatment of an already finally produced and completely solidified nonwoven fabric web, or of such a nonwoven fabric, respectively. Such a subsequent treatment can be, for example, a finish such as, for example, an application of color or glue. In principle, a liquid or pasty application medium can be applied to the completely solidified nonwoven fabric web. The treatment in turn is drying in order for said application medium to be dried. The drying can then be carried out according to the invention as has been explained in the context of the production.

A method for treating a nonwoven fabric web, preferably wet-laid according to the invention, can comprise the following steps:

a) providing a nonwoven fabric web comprising industrially generated inorganic fibers, or fibers from synthetically generated polymers;
b) applying an application medium to the surface of the nonwoven fabric web;
c) thermal drying of the nonwoven fabric web in an alternating manner by means of infrared radiation and hot air, in order for the nonwoven fabric web to be dried.

The treatment and the mentioned method for treatment can be performed in-line, thus within a single machine without any intervening winding of the nonwoven fabric web, or else off-line, thus by way of such an intervening winding of the finished nonwoven fabric web and downstream unwinding including a subsequent application of an application medium and subsequent drying according to the invention.

The term final strength is meant to be understood as such a high strength of the nonwoven fabric web that the latter can be transported within the drying section or to another section of the machine without a belt supporting from below being required herein (free draft).

Strength can refer, for example, to the tensile strength of the fibrous web/nonwoven fabric web.

When mention is made according to the invention of thermal drying of the fibrous web in an alternating manner by means of infrared radiation and hot air, in order for the nonwoven fabric web to be produced, this is understood to be an alternating impingement of the fibrous web by means of thermal radiation and convection, when viewed in the running direction of the fibrous web. In other words, the fibrous web across the entire width thereof in the running direction is first radiated by means of infrared, then dried in a convective manner by means of hot air, then in turn radiated by means of infrared, and so forth. This means that one and the same portion of a fibrous web which runs in the running direction through the drying device, at all times runs through the successively disposed combination dryers and thus in an alternating manner through the infrared dryer and the hot air dryer of a respective combination dryer.

This is achieved in that the nonwoven fabric web within the drying section of the machine runs through a drying device having a plurality of combination dryers which are successively disposed in the running direction of the nonwoven fabric web.

Fibrous suspension in the context of the invention is to be understood to be a mixture from a liquid, such as water, and fibers.

A former, such as an inclined screen former, in the context of the invention is assigned a forming screen which at least in distances, for example along a first portion of a distance, runs at an angle in relation to the horizontal. At least one headbox is then disposed in said portion of the distance in such a manner that said headbox applies the fibrous suspension to the upper side of the forming screen. Upper side means that the fibrous suspension is applied to the upper side of the forming screen. This is that side that faces away from the rollers on which said forming screen revolves, on the one hand, and faces the outlet of the headbox, on the other hand. At least one dewatering element for the dewatering of the fibrous suspension just applied can be disposed on the lower side, thus in the region of the lower side of the forming screen. The headbox in turn can be assigned to the inclined screen former. The inclined screen former is typically disposed in such a manner that the first portion of the distance in the direction of the deposited fibrous web ascends at an angle, when viewed in relation to a horizontal plane. Such a former can be part of a forming section of the machine for producing such a nonwoven fabric.

In the context of the invention, a forming screen, a transport belt, or simply a belt, is typically embodied as a continuous loop which revolves on rollers, for example. Said forming screen can be permeable to water.

The decomposition temperature is understood to be the temperature at which the material of the fibers is chemically or thermally decomposed, respectively. For example, the decomposition temperature is characteristic for materials which do not melt such as, for example, thermosetting plastics. The melting temperature is understood to be that temperature at which the material, for example of the fibers, transitions from the solid state to the melt.

The term elasticity modulus is understood to be a material key indicator from the field of material technology which describes the correlation between tension and elongation in the deformation of a solid body in the case of a linear-elastic behavior.

The nonwoven fabrics according to the invention can preferably be produced from glass fibers, metal fibers, mineral fibers, ceramic fibers, or carbon fibers. Fibers of this type can also be synthetic fibers such as aramid fibers, or else mineral fibers such as basalt fibers. In the case of metallic fibers, steel fibers, stainless steel fibers, or titanium fibers can be considered, for example. The materials mentioned often have an elasticity modulus of at least 10 GPa. Said materials in this instance are comparatively hard, brittle, and flexurally rigid, and cannot readily interloop or entangle with one another. Therefore, it is particularly advantageous when said fibers are connected to one another by means of a binding agent, for example in a bonding section of the machine.

In order for the solidified nonwoven fabric web to be dried in a rapid and effective manner, said nonwoven fabric web, additionally to the thermal drying, can also be mechanically dewatered, for example by means of a press.

When mention is made according to the invention of a machine, the machine mentioned at the outset for producing or drying, respectively, such a nonwoven fabric web from a wet-laid fibrous web is meant at all times.

The present invention furthermore relates to the use of a drying device for drying the wet-laid nonwoven fabric web according to the invention.

The present invention also relates to a machine which the mentioned forming section having the former such as an inclined screen former, a bonding section, and a drying section, comprising at least the drying device according to the invention, in order for the wet-laid nonwoven fabric web according to the invention to be produced.

The present invention also relates to the product produced directly by means of the method according to the invention, thus to the nonwoven fabric per se.

BRIEF DESCRIPTION OF THE SEVERAL VIEWS OF THE DRAWING

The invention will be explained in more detail hereunder with reference to the drawings and without limiting the generality. In the drawings.

DESCRIPTION OF THE INVENTION

Figure 1:
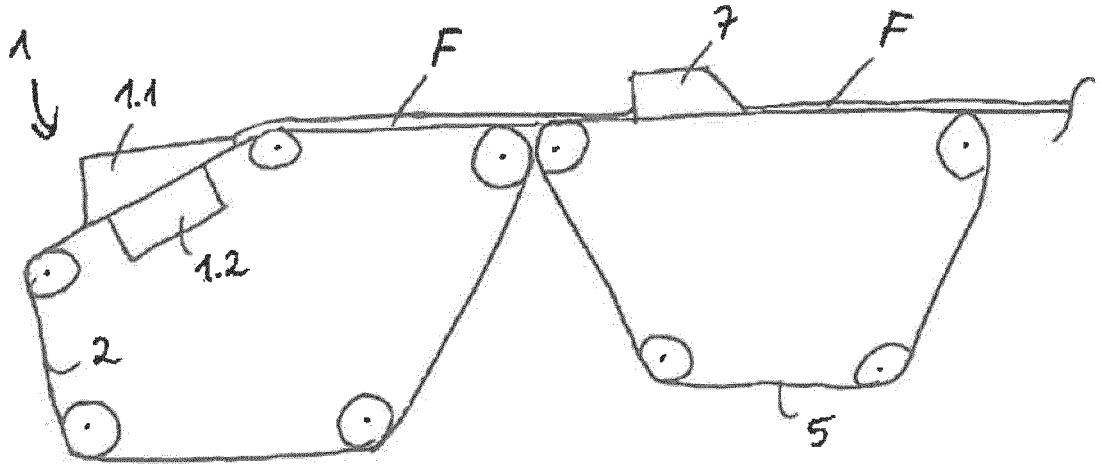
FIG. 1 shows a highly schematic partial illustration of a machine for producing a nonwoven fabric web, in a lateral view.

Part of a machine for wet-laying a nonwoven fabric web is illustrated in a lateral view in a schematic manner and therefore not-to-scale in FIG. 1. The device comprises a former, presently embodied as an inclined screen former 1. Said inclined screen former 1 is assigned a continuous forming screen 2 which here revolves on rollers. Said forming screen 2 revolves relative to the stationary inclined screen former 1. A headbox 1.1 is disposed above the forming screen 2. Said headbox 1.1 is assigned to the inclined forming screen 1. A fibrous suspension is capable of being fed to the headbox 1.1, said fibrous suspension by way of an outlet of the headbox 1.1 being capable of being applied to the forming screen 2, more specifically to the upper side of the latter. The fibrous suspension typically comprises a water/fiber mixture. The forming screen 2 is embodied such that said forming screen 2 allows water to pass through. A dewatering box 1.2 for discharging the water of the fibrous suspension is disposed below the forming screen 2 on that side that faces the headbox 1.1. The dewatering box 1.2 is assigned to the inclined screen former 1.

In the intended operation of the device, the fibrous suspension, by way of the outlet of the headbox 1.1, makes its way onto the forming screen 2 which by way of the rollers moves relative to the headbox 1.1 or to the dewatering box 1.2, respectively. The water flows out through the forming screen 2 into the dewatering box 1.2. The fibers from the fibrous suspension herein are trapped on the forming screen 2 and are transported onward conjointly with the latter. A corresponding fibrous web F is continuously deposited or formed, respectively, in this manner on the forming screen 2.

The forming screen 2, when viewed in the running direction thereof, or in the running direction of the fibrous web F, respectively, in a first portion of the distance is inclined upward, counter to the horizontal. The inclined screen former 1 is disposed in this first portion of the distance, that is to say that the fibrous web F is formed on said portion. The first portion of the distance herein is delimited by the upper rollers which are directly successive in the running direction of the supporting screen 2. To this end, at least two such upper rollers are provided. In the illustration shown, the forming screen 2, presently revolving in the clockwise direction, thus in said first portion of the distance ascends from the bottom left to the top right. The former could also be embodied in a manner other than the inclined screen former 1 illustrated.

The former including the forming screen 2, the headbox 1.1 and the dewatering box 1.2, is part of the forming section of the machine for producing the nonwoven fabric web V from the wet-laid fibrous web F. In the running direction of the fibrous web F to be produced, a bonding section of the machine presently directly adjoins the forming section. Said bonding section presently comprises an application device 7 which is disposed above a transporting screen 5 which runs horizontally, or at least in portions runs substantially parallel to the horizontal plane, respectively. The nonwoven fabric web V can be soaked with a chemical binding agent by means of the application device 7. However, the application device 7 could also be embodied in a manner deviating from the embodiment shown.

For example, a drying device 3 (see FIG. 2) for drying the fibrous web F provided by means of the binding agent can directly adjoin the bonding section in the running direction of the nonwoven fabric web V to be produced, said running direction of the nonwoven fabric web V simultaneously corresponding to the running direction of the fibrous web F (in the view of FIG. 1 from left to right). Directly means that the impregnation of the fibrous web F by means of the binding agent is performed directly prior to the drying of the fibrous web F without any other processing or finishing steps of the fibrous web F taking place in the meantime.

In principle, it would be conceivable for the binding agent application to take place already on the forming screen 2. To this end, the application device 7, when viewed in the running direction of the fibrous web F, would be disposed behind the former. The latter in such a manner that said application device 7 dispenses the binding agent from above onto the fibrous web F that is deposited on the forming screen 2. Alternatively, it would also be possible for the fibrous web F to be impregnated with the binding agent in that such a binding agent is added to the fibrous suspension before the latter is applied to the forming screen 2.

Figure 2:
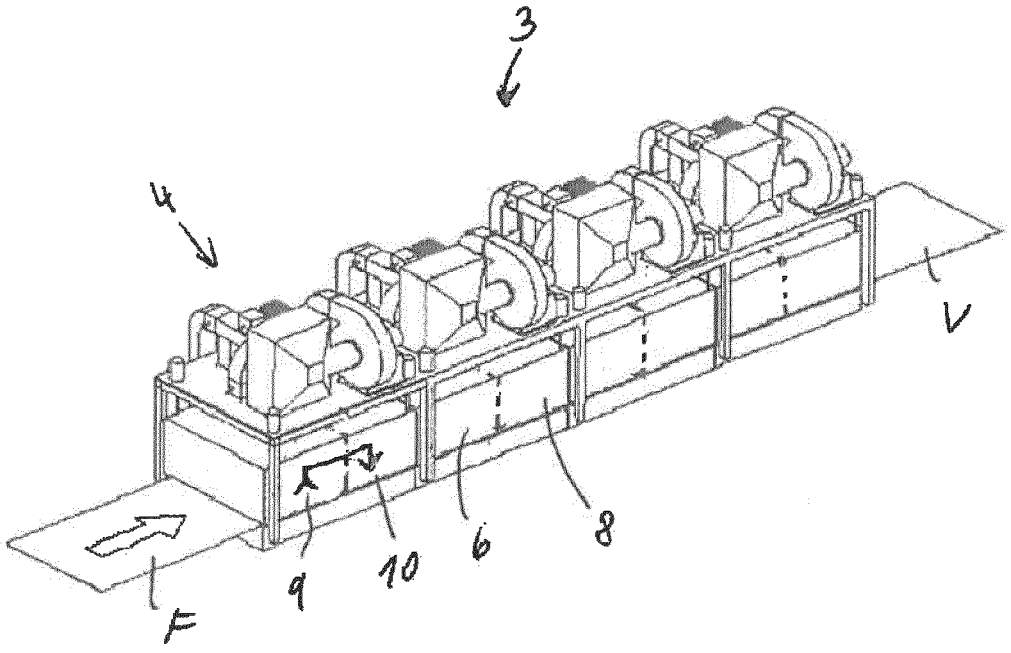
FIG. 2 shows a highly schematic illustration of a drying device according to the invention, according to one embodiment, in a three-dimensional view.

A drying device 3 according to the invention, such as could adjoin the bonding section of FIG. 1 in the running direction of the fibrous web F, is illustrated in FIG. 2. As is indicated by the arrow, the fibrous web F generated in the forming section first makes its way into the drying device 3. When the fibrous web F leaves the drying device 3, said fibrous web F is finally solidified so as to form the actual nonwoven fabric web V.

The length of the drying device 3, thus the length of the action of heat on the fibrous web F to be dried, is also referred to as the drying distance.

The drying device 3 comprises at least one combination dryer 4. In the present case, four combination dryers 4 which are successively disposed in the running direction of the fibrous web F, are provided. Said four combination dryers 4 are disposed so as to be directly contiguous to one another. This means that when the fibrous web F to be dried leaves a first combination dryer 4, said fibrous web F makes its way directly into the following combination dryer 4, when viewed in the running direction.

Each of the combination dryers 4 comprises in each case one infrared dryer 6 and one hot air dryer 8. All combination dryers herein are specified such that, when viewed in the running direction of the fibrous web F, drying is performed in an alternating manner by means of infrared radiation from the associated infrared dryer 6, then by means of convection by the corresponding hot air dryer 8, in a corresponding manner again by means of heat radiation, and so forth. As soon as the fibrous web F, when viewed in the running direction thereof, has left the first combination dryer 4, said fibrous web F makes its way into the second combination dryer 4. Said fibrous web F therein, again when viewed in the running direction of said fibrous web F, is first dried by the corresponding infrared dryer 6, then by the corresponding hot air dryer 8. In other words, in each case when viewed in the running direction of the fibrous web 7 through the drying device 3, one hot air dryer 8 assigned to the first combination dryer 4 is in each case disposed between an infrared dryer 6 of a first combination dryer 4 in the running direction, and between an infrared dryer 6 of a further combination dryer 4 that directly follows in the running direction. It could also be said that the fibrous web F along the drying distance is dried in an alternating manner by means of heat radiation, then by means of convection, in turn by means of heat radiation, and so forth. To this end, the combination dryers 4 are successively disposed in a corresponding manner along the drying distance.

The infrared dryer 6 of a respective combination dryer 4 can be embodied as a gas-fired infrared dryer. To this end, the infrared dryer 6 can comprise one or a plurality of infrared radiators (not shown). The exhaust gases generated by means of the infrared radiator can in this instance be suctioned from the infrared dryer 6 by way of one or a plurality of suction nozzles 9 that are assigned to the infrared dryer 6, only one of said suction nozzles 9 being purely schematically indicated here. The at least one suction nozzle 9 can be disposed within a housing that surrounds the infrared dryer 6.

The respective hot air dryer can comprise one or a plurality of blower nozzles 10, of which likewise only one is illustrated in a purely schematic manner here. The at least one blower nozzle 10 serves inter alia for feeding heated air to the fibrous web F in order for the latter to be dried. To this end, the at least one blower nozzle 10 can be fluidically connected to a fresh air intake (not shown), on the one hand. Moreover, a fluidic connection can be provided between the at least one suction nozzle 9 and the at least one blower nozzle 10 of one and the same combination dryer 4. By means of said fluidic connection, the thermal energy contained in the exhaust gas of the infrared dryer 6 can be utilized for heating the fresh air, or for drying the fibrous web F also by means of the thermal energy of the exhaust gas of the respective infrared dryer 6, respectively.

Independently of the embodiments illustrated in the figures, it is in principle advantageous for the drying device 3 to be specified in such a manner that the heating temperature or the heating output of the individual combination dryers 4, when viewed in the running direction of the fibrous web F to be dried, is dissimilar, or is capable of being set in a mutually independent manner, respectively. The drying output can thus be adapted in an optimal manner to the fibers of the fibrous web F to be dried, and the optimal strength of the nonwoven fabric web V to be produced can thus be set in a targeted manner. It has been demonstrated herein that it is advantageous for the drying device 3 to be specified in such a manner that the heating output or the heating temperature, when viewed in the running direction of the fibrous web F to be dried, increases from one combination dryer 4 to the next combination dryer 4. In other words, a temperature profile can be imposed on the entire drying device 3 in the running direction of the fibrous web F to be dried, thus when viewed across the entire drying distance, said temperature profile being kept constant in the operation of the drying device 3. Within the respective combination dryer 4, the temperature both in the infrared dryer 5 as well as in the hot air dryer 8 can be set so as to be constant. For example, the temperature profile can increase in steps from the first to the second and toward the third combination dryer 4 in the running direction of the fibrous web F to be dried, for example, and drop again in the fourth (last or further) combination dryer 4. Since the moisture content of the fibrous web F continuously decreases when passing through the drying device 3, a lower heating output is also required toward the end of the drying within the drying device 3. Depending on the type of the fibers of the fibrous web F, a corresponding temperature profile can be predefined for the drying device 3 and thus for the combination dryers 4, in order for the fibrous web F in this instance to be dried in an optimal manner so as to form the nonwoven fabric web V.

Independently of the embodiments illustrated, the fibrous web F according to the invention is solidified in a purely chemical manner such that the final nonwoven fabric web V is created. This takes place by the addition and the subsequent drying of the chemical binding agent contained in the fibrous web F.

The final strength of the nonwoven fabric web V can be achieved in a comparatively short time by means of the present invention. The nonwoven fabric web can thus be transferred faster than to date by way of a free draft to another belt such as a transport belt for further processing or winding in a further section of the machine for producing such nonwoven fabric webs, without said non-woven fabric web breaking.

It has been demonstrated that the invention displays the advantages mentioned at the outset particularly positively in the case of nonwoven fabrics produced from inorganic fibers such as glass fibers.

LIST OF REFERENCE SIGNS

1 Inclined screen former
1.1 Headbox
1.2 Dewatering box
2 Forming screen
3 Drying device
4 Combination dryer
5 Transporting screen
6 Infrared dryer
7 Application device
8 Hot air dryer
F Fibrous web
V Nonwoven fabric web

The invention claimed is:

1. A method of producing a wet-laid nonwoven fabric web, the method comprising the following steps:

a) providing a fibrous web formed of industrially generated inorganic fibers, or fibers from synthetically generated polymers; and b) thermally drying the fibrous web by alternatingly subjecting the fibrous web to infrared radiation and to hot air, to generate the nonwoven fabric web, and thereby blowing the hot air onto the fibrous web with air blowers that aspirate fresh air.

2. The method according to claim 1, which comprises providing a fibrous suspension of industrially generated inorganic fibers, or fibers from synthetically generated polymers, and producing the fibrous web by feeding the fibrous suspension onto a forming screen for depositing the fibrous web on the forming screen.

3. The method according to claim 1, which comprises selecting fibers with a decomposition or melting temperature of at least 300° C.

4. The method according to claim 1, which comprises using fibers having an elasticity modulus of at least 10 GPa.

5. The method according to claim 4, which comprises selecting the fibers from the group consisting of glass, metal, mineral, ceramics, carbon, and combinations of the aforementioned materials.

6. The method according to claim 1, wherein the fibers have an average length from 2 to 40 mm.

7. The method according to claim 1, which comprises chemically solidifying the fibrous web prior to thermal drying.

8. The method according to claim 7, which comprises chemically solidifying the fibrous web by soaking the fibrous web with a binding agent.

9. The method according to claim 1, which comprises heating the fresh air by heat exchange with thermal energy contained in exhaust gas generated by the infrared irradiation.

10. A drying device for producing a wet-laid nonwoven fabric web, the drying device comprising:

a forming screen for carrying a fibrous web formed from a fibrous suspension of industrially generated inorganic fibers, or fibers from synthetically generated polymers;

a plurality of combination dryers disposed along the forming screen in a running direction of the fibrous web to be dried;

each of said combination dryers including at least one infrared dryer and at least one hot air dryer, and said hot air dryer of each said combination dryer being disposed downstream of said infrared dryer in the running direction of the fibrous web to be dried, and being configured to aspirate fresh air.

11. The drying device according to claim 10, wherein said infrared dryer is a gas-fired infrared dryer.

12. The drying device according to claim 11, wherein said infrared dryer has a plurality of gas-fired infrared radiators and at least one suction nozzle for suctioning off exhaust gases generated within said infrared dryer.

13. The drying device according to claim 12, wherein said hot air dryer includes at least one blower nozzle for directing hot air onto the fibrous web to be dried.

14. The drying device according to claim 13, wherein said at least one suction nozzle of said gas-fired infrared dryer is fluidically connected to said at least one blower nozzle of said hot air dryer such that the exhaust gases generated within said infrared dryer and suctioned off by way of said suction nozzle are available to be fed to said at least one blower nozzle of said hot air dryer, and to deliver the exhaust gases onto the fibrous web to be dried.

15. The drying device according to claim 10, wherein a heating temperature or a heating output of said combination dryers, when viewed in the running direction of the fibrous web to be dried, is dissimilar.

16. The drying device according to claim 15, wherein the heating output or the heating temperature of said combination dryers, when viewed in the running direction of the fibrous web to be dried, increases from one combination dryer to a following combination dryer.

17. The drying device according to claim 10, wherein said combination dryers are configured for setting a heating temperature or a heating output thereof independently of one another.

18. The drying device according to claim 10, wherein said forming screen and said plurality of combination dryers in the drying installation are configured for carrying out the method according to claim 1.

19. The drying device according to claim 10, wherein said hot air dryer is configured to aspirate fresh air, to heat the fresh air with thermal energy contained in exhaust gas generated by said infrared dryer, and to blow the heated fresh air onto the fibrous web to be dried.

20. A drying device for producing a wet-laid nonwoven fabric web which is generated by depositing a fibrous web from a fibrous suspension containing industrially generated inorganic fibers, or fibers from synthetically generated polymers, the drying device comprising a plurality of combination dryers disposed along the drying device in a running direction of the fibrous web to be dried, wherein each said combination dryer includes at least one infrared dryer and at least one hot air dryer, and said hot air dryer of one and the same combination dryer in the running direction of the fibrous web is in each case disposed downstream of the infrared dryer of one and the same combination dryer, and wherein said hot air dryer is configured to aspirate fresh air, to heat the fresh air with thermal energy contained in exhaust gas generated by said infrared dryer, and to blow the heated fresh air onto the fibrous web to be dried.

* * * * *